US007198596B2

(12) United States Patent
Westerkull

(10) Patent No.: US 7,198,596 B2
(45) Date of Patent: Apr. 3, 2007

(54) COUPLING DEVICE FOR A TWO-PART BONE-ANCHORED HEARING AID APPARATUS

(75) Inventor: Patrik Westerkull, Hovås (SE)

(73) Assignee: P & B Research AB, Göteborg (SE)

( * ) Notice: Subject to any disclaimer, the term of this patent is extended or adjusted under 35 U.S.C. 154(b) by 201 days.

(21) Appl. No.: 10/481,586

(22) PCT Filed: Jun. 6, 2002

(86) PCT No.: PCT/SE02/01088

§ 371 (c)(1),
(2), (4) Date: Jun. 1, 2004

(87) PCT Pub. No.: WO03/001845

PCT Pub. Date: Jan. 3, 2003

(65) Prior Publication Data

US 2004/0210103 A1 Oct. 21, 2004

(30) Foreign Application Priority Data

Jun. 21, 2001 (SE) ..... 0102207

(51) Int. Cl.
*H04R 25/00* (2006.01)

(52) U.S. Cl. ..... 600/25

(58) Field of Classification Search ..... 600/25; 381/312–331; 181/128–130; 607/55–57
See application file for complete search history.

(56) References Cited

U.S. PATENT DOCUMENTS

| | | | | |
|---|---|---|---|---|
| 4,352,960 | A * | 10/1982 | Dormer et al. | 607/57 |
| 4,498,461 | A | 2/1985 | Hakansson | |
| 4,612,915 | A | 9/1986 | Hough et al. | |
| D294,295 | S | 2/1988 | Brånemark | |
| 4,957,478 | A | 9/1990 | Maniglia | |
| 4,979,087 | A * | 12/1990 | Sellwood et al. | 363/34 |
| 5,015,224 | A | 5/1991 | Maniglia | |
| 5,217,011 | A | 6/1993 | Bisch | |
| 5,735,790 | A | 4/1998 | Håkansson et al. | |
| 6,171,229 | B1 | 1/2001 | Kroll et al. | |
| 2005/0249366 | A1 * | 11/2005 | Westerkull | 381/151 |

FOREIGN PATENT DOCUMENTS

WO WO 0209622 A1 2/2002

* cited by examiner

*Primary Examiner*—John P. Lacyk
(74) *Attorney, Agent, or Firm*—Venable LLP; Eric J. Franklin

(57) ABSTRACT

A coupling device for attaching the external hearing aid part to the skull bone anchored part in a bone conducting hearing aid apparatus. The retaining force in the coupling device is substantially established with a permanent magnet. The bone anchored part and the external hearing aid part include a magnetic part.

17 Claims, 1 Drawing Sheet

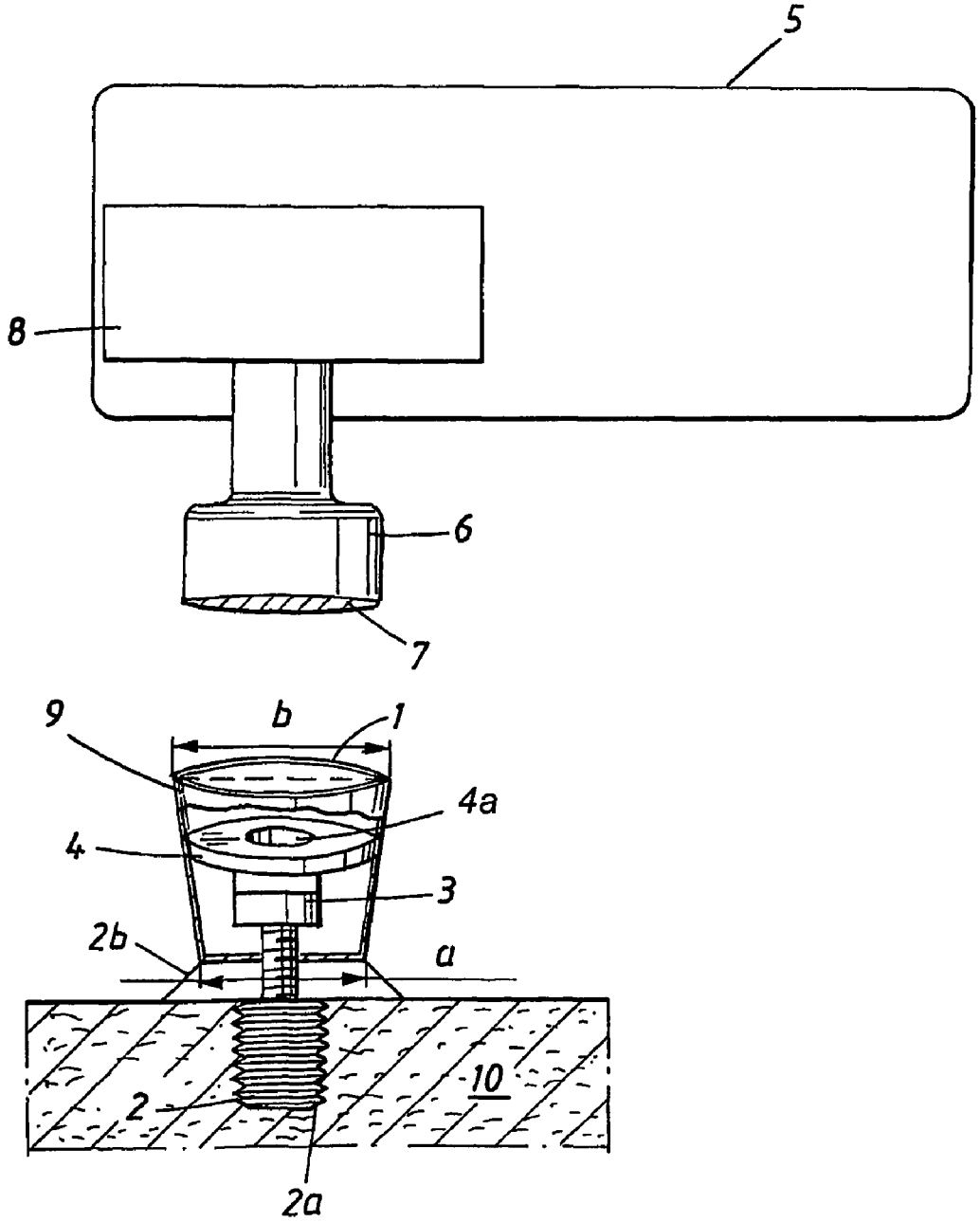
5
8
6
7
9
b
1
4a
4
3
2b
a
10
2
2a

COUPLING DEVICE FOR A TWO-PART BONE-ANCHORED HEARING AID APPARATUS

CROSS-REFERENCE TO RELATED APPLICATIONS

This application claims priority to Swedish patent application 0102207-8 filed 21 Jun. 2001 and is the national phase under 35 U.S.C. § 371 of PCT/SE02/01088.

FIELD OF THE INVENTION

The present invention relates to a coupling device for attaching the external hearing aid part to the skull bone anchored part in a bone conducting hearing aid apparatus.

BACKGROUND OF THE INVENTION

For persons who cannot benefit from traditional, air conduction hearing aids there are other types of sound transmitting hearing aids on the market, i e bone anchored hear ring aids which mechanically transmit the sound information to a persons inner ear via the skull bone by means of a vibrator. The hearing aid device is connected to an anchoring element in the form of an implanted titanium screw installed in the bone behind the external ear and the sound is transmitted via the skull bone to the cochlea (inner ear), i e the hearing aid works irrespective of a disease in the middle ear or not. The bone anchoring principle means that the skin is penetrated which makes the vibratory transmission very efficient.

This type of hearing aid device has been a revolution for the rehabilitation of patients with certain types of impaired hearing. It is very convenient for the patient and almost invisible with normal hair styles. It can easily be connected to the implanted titanium fixture by means of a bayonet coupling or a snap in coupling. Examples of this type of hearing aid devices are described in U.S. Pat. Nos. 4,498,461 and 5,735,790. It is also referred to the BAHA® bone anchored hearing aid marketed by Entific Medical Systems in Göteborg.

The previously known coupling devices for said hearing aids are all based on mechanically spring actuated parts. The disadvantage with such coupling details is the fact that they are exposed to mechanical wear so that in course of time there is a play in the system and other troubles when connecting the hearing aid device.

SUMMARY OF THE INVENTION

One object of the present invention is to provide a coupling device for a hearing aid apparatus which is less exposed to mechanical wear compared to the previously known coupling devices with mechanically spring actuated parts.

According to the invention, the retaining force in the coupling device is substantially established by means of a permanent magnet.

According to a preferred embodiment the bone anchored part as well as the hearing aid device itself comprises a magnetic part and at least one of these magnetic parts is a permanent magnet.

BRIEF DESCRIPTION OF THE DRAWINGS

In the following the invention will be described more in detail with reference to the accompanying drawing in which a bone anchored hearing aid with a coupling device according to the invention is schematically illustrated.

DETAILED DESCRIPTION OF EMBODIMENTS OF THE INVENTION

The FIGURE shows the two main parts of the hearing aid apparatus, the bone anchored part and the hearing aid part 5 which is intended to be connected to the bone anchored part. The bone anchored part comprises a skin penetrating spacer 1 which is attached by means of a connecting screw 3 to an anchoring element, a fixture 2, anchored in the skull bone 10. The fixture is preferably made of titanium which has a known ability to integrate into surrounding bone tissue, so-called osseointegration. The fixture has a main body 2*a* with external threads to be inserted into the skull bone, a flange 2*b* which functions as a stop means when the fixture is installed into the skull bone 10 and a tool engaging socket, for instance in the form of an external hex (not shown here). The main body 2*a* is shorter than 5 mm, in order not to go completely through the thin skull bone. One example of such a fixture is illustrated in U.S. Des. Pat. No. 294,295.

The apical part of the main body 2*a* of the fixture can be designed with cutting edges which are self-tapping when the anchoring element is installed into a hole drilled in the bone with a hole diameter corresponding to the inner diameter of the screw thread profile. One example of such a fixture is described in Swedish patent application 0002627-8.

The skin penetrating spacer 1 comprises an annular magnetic part 4 so that the connecting screw 3 can be easily reached in the center 4*a*. As an alternative the magnetic part 4 can be detacheable so that the connecting screw 3 can be reached in this way. As a further alternative the magnetic part can be integral with the connecting screw so that they are disengaged together.

Preferably the skin penetrating spacer has a conical form so that the spacer part adjacent to the fixture has a smaller diameter at the base compared to the upper diameter b of the spacer. In such a way the contact surface of the magnetic part 4 can be made larger without a corresponding increase of the diameter at the base of the spacer.

The hearing aid part 5 also comprises a magnetic part 6 having a magnetic surface 7 for attaching to the corresponding magnetic part 4 of the skin penetrating spacer. The magnetic contact surface 7 is mechanically connected to the vibrator 8 in the hearing aid part. The hearing aid part with the vibrator and other electronics can be of a type which is known per se and will therefore not be described in any detail here.

At least one of the two magnetic parts 4 and 6 in the skin penetrating spacer and the hearing aid part, respectively, should contain a permanent magnet. In case of a permanent magnet in only one of said magnetic parts, the other part should then be made of a ferromagnetic material. The magnets as well as the ferro-magnetic material should be surface treated in order to avoid corrosion on the surfaces of these magnetic materials.

Sintered magnets usually have stronger magnetic properties than other types of magnets, so therefore it could be an advantage to use such type of magnets for a good retention of the hearing aid and a possible reduction of the size of the magnetic coupling device.

To facilitate the connection of the external hearing aid part 5 the skin penetrating spacer is provided with an annular flange 9 or central boss which projects outwards from the magnetic contact surface to prevent the hearing aid from sliding off the magnetic surface in a lateral direction. As an alternative such a flange or central boss could be arranged on the magnetic coupling part 6 on the hearing aid part 5.

In one embodiment, magnetic part of the bone anchored part of the hearing aid is replaceable by a snap-in or screw retaining means in the skin penetrating spacer.

In the example illustrated in the FIGURE the skin penetrating spacer 1 and the fixture 2 are illustrated as two separate parts which are attached to each other by means of a connecting screw 3. As an alternative the spacer and the fixture can be made in one piece in which case no connecting screw is required. In this case the magnetic part can be integral with this one piece or it can be made as a replaceable piece.

The invention claimed is:

1. A coupling device for attaching an external bone conducting hearing aid to a patient, the coupling device comprising:

an anchoring element operative to be anchored in a skull bone of the patient;

a skin penetrating member;

a first magnetic member operatively connected to the skin penetrating member and comprising a magnetic contact surface; and a second magnetic member operatively connected to the external bone conducting hearing aid and comprising a magnetic contact surface operative to attach to the magnetic contact surface of the first magnetic member and thereby attach the external bone conducting hearing aid to the skin penetrating member.

2. The coupling device according to claim 1, wherein the anchoring element comprises a screw.

3. The coupling device according to claim 1, wherein at least one of the first magnetic member and the second magnetic member is a permanent magnet.

4. The coupling device according to claim 1, wherein one of the first magnetic part and the second magnetic part is a permanent magnet and another of the first magnetic part and the second magnetic part comprises a ferro-magnetic material.

5. The coupling device according to claim 1, wherein the first magnetic part comprises an annular magnetic part.

6. The coupling device according to claim 1, wherein the skin penetrating member and connecting screw comprise a single piece.

7. The coupling device according to claim 6, wherein the first magnetic part is integral with the skin penetrating member and connecting screw.

8. The coupling device according to claim 3, wherein the permanent magnet is a sintered magnet.

9. The coupling device according to claim 3, wherein the permanent magnet comprises a non-corrosive surface layer material.

10. The coupling device according to claim 4, wherein the permanent magnet is a sintered magnet.

11. The coupling device according to claim 4, wherein the permanent magnet and the ferro-magnetic material both comprise a non-corrosive surface layer material.

12. The coupling device according to claim 1, wherein the first magnetic part is arranged in the skin penetrating member in such a way that at least a part of the skin penetrating member projects outwards from the magnetic contact surface.

13. The coupling device according to claim 1, wherein a diameter of the skin penetrating member adjacent to the skull bone is smaller than a diameter of a portion of the skin penetrating member in the vicinity of the external bone conducting hearing aid.

14. The coupling device according to claim 1, wherein one of the skin penetrating member and the external bone conducting hearing aid comprises a flange operative to prevent the external bone conducting hearing aid from sliding off the skin penetrating member.

15. The coupling device according to claim 1, wherein the anchoring element comprises a flange operative to limit penetration of the anchoring element in the skull bone.

16. The coupling device according to claim 1, further comprising:

a connecting screw operatively connecting the skin penetrating member to the anchoring element.

17. The coupling device according to claim 16, wherein the first magnetic part is integral with the connecting screw.

* * * * *